US005788104A

United States Patent [19]

Hoyt

[11] Patent Number: 5,788,104

[45] Date of Patent: Aug. 4, 1998

[54] COMBINATION CAP AND MATERIAL TOOLING DEVICE

[75] Inventor: Earl E. Hoyt, Franklin Lakes, N.J.

[73] Assignee: DAP Products Inc., Baltimore, Md.

[21] Appl. No.: 106,489

[22] Filed: Aug. 13, 1993

[51] Int. Cl.[6] ..... B65D 41/56

[52] U.S. Cl. ..... 220/212; 220/695; 220/700; 15/236.01; 15/245.1; 401/123; 401/130; 401/266

[58] Field of Search ..... 220/212, 212.5, 220/649, 695, 696, 700; 215/228; 15/236.01, 245.1; 401/123, 130, 139, 195, 261, 266

[56] References Cited

U.S. PATENT DOCUMENTS

| | | | |
|---|---|---|---|
| 708,709 | 9/1902 | Henneberry et al. | 401/266 X |
| 1,598,811 | 9/1926 | Ferrin | 401/139 X |
| 1,766,529 | 6/1930 | Peirson | 401/139 X |
| 2,014,149 | 9/1935 | Stafford | 401/139 X |
| 2,716,251 | 8/1955 | Pearce | 401/139 X |
| 2,930,063 | 3/1960 | Stell | 215/228 X |
| 3,133,300 | 5/1964 | Freeman . | |
| 3,185,351 | 5/1965 | Klun | 401/139 X |
| 3,963,357 | 6/1976 | Crisp . | |
| 4,652,163 | 3/1987 | Karliner et al. | 401/123 X |

FOREIGN PATENT DOCUMENTS

| | | | |
|---|---|---|---|
| 826016 | 12/1937 | France | 401/139 |
| 110540 | 5/1944 | Sweden | 401/139 |

*Primary Examiner*—Stephen Cronin
*Attorney, Agent, or Firm*—Biebel & French

[57] ABSTRACT

A combination cap and material tooling device is provided including an elongated blade supported on a base wherein the base includes an engagement portion and an intermediate portion. The engagement portion is preferably provided with threads for engaging threads on a container for a spackling stick whereby the contents of the container may be sealed from air to thereby preserve the contents in a soft pliable putty-like consistency. The intermediate portion is located between the blade and the engagement portion and includes a finger depression for receiving an operator's finger whereby the base may be comfortably used to guide the blade in a spackling operation.

9 Claims, 4 Drawing Sheets

COMBINATION CAP AND MATERIAL TOOLING DEVICE

BACKGROUND OF THE INVENTION

The present invention relates to a device for use with a spackling stick and, more particularly, to a combination cap and material tooling device for sealing a spackling stick container and for spreading spackling on a surface.

A spackling operation typically involves providing a putty-like spackling material from a container and spreading the material using a putty or spackling knife. In one known method of applying spackling, the spackling is provided in the form of a spackling stick which is sealed within a container. The spackling is dispensed from the container by providing a rotatable member at an end of the container, opposite from the spackling stick, and a platform member supporting the spackling stick is threadably engaged with the rotatable member. Thus, the spackling stick may be dispensed from the container by rotating the rotatable member to cause the platform member to push the spackling stick outwardly through the open end of the container. When the spackling stick is not in use, it is necessary to cap the container in order to avoid the spackling from drying and hardening. In addition, after the spackling is applied to a surface, a spackling knife may be used to move the spackling over surface imperfections such as cracks, crevices and nail holes.

One problem associated with a typical spackling operation results from the need to provide a spackling knife separate from the spackling container such that two separate articles must be provided to perform a spackling operation. This may lead to the spackling knife becoming misplaced or lost such that the person performing the spackling operation, such as a do-it-yourselfer, will often resort to use of an alternative tool, for example a screwdriver or other flat bladed tool, and obtain results which have a less than professional appearance.

Accordingly, it is desirable to provide a combination tool which may be provided in association with a container for spackling wherein the combination tool may be used for both capping the container and for spreading the spackling.

SUMMARY OF THE INVENTION

The present invention provides a combination cap and material tooling device for use with a spackling stick including a container for dispensing the spackling.

In one aspect of the invention, the combination cap and material tooling device comprises a blade portion, an engagement portion for engaging a container in sealing engagement and an intermediate portion extending between the blade portion and the engagement portion wherein the intermediate portion and the engagement portion define a handle for supporting the blade portion. The blade portion is preferably formed as a planar member having substantially planar opposing front and rear surfaces wherein the rear surface defines a working surface for spreading spackling material.

In a further aspect of the invention, the intermediate portion includes opposing substantially planar front and rear faces which angle toward each other in a direction away from the engagement portion. The intermediate portion further includes opposing curved side walls connecting the front and rear faces, and the blade defines a plane passing through each of the curved side walls.

Further, a finger depression is provided defined by a concave recess formed in one of the front and rear faces of the intermediate portion for receiving a finger of an operator such that the handle may be conveniently gripped during use of the blade to spread material. The recess also helps the operator to correctly orient the working surface of the blade toward the surface to be spackled.

The engagement portion is preferably formed having a cylindrical shape for extending around and threadably engaging the container in sealing engagement whereby spackling within the container is protected from air infiltration to preserve the soft putty-like consistency of the spackling material.

Therefore, it is a primary object of the present invention to provide a device for sealingly capping a container and for spreading material supplied from within the container.

It is a further object of the invention to provide a combination cap and material tooling device including a blade portion wherein a portion of the device defines a handle for conveniently holding the blade.

Other objects and advantages of the invention will be apparent from the following description, the accompanying drawings, and the appended claims.

DETAILED DESCRIPTION OF THE PREFERRED EMBODIMENT

Figure 1:
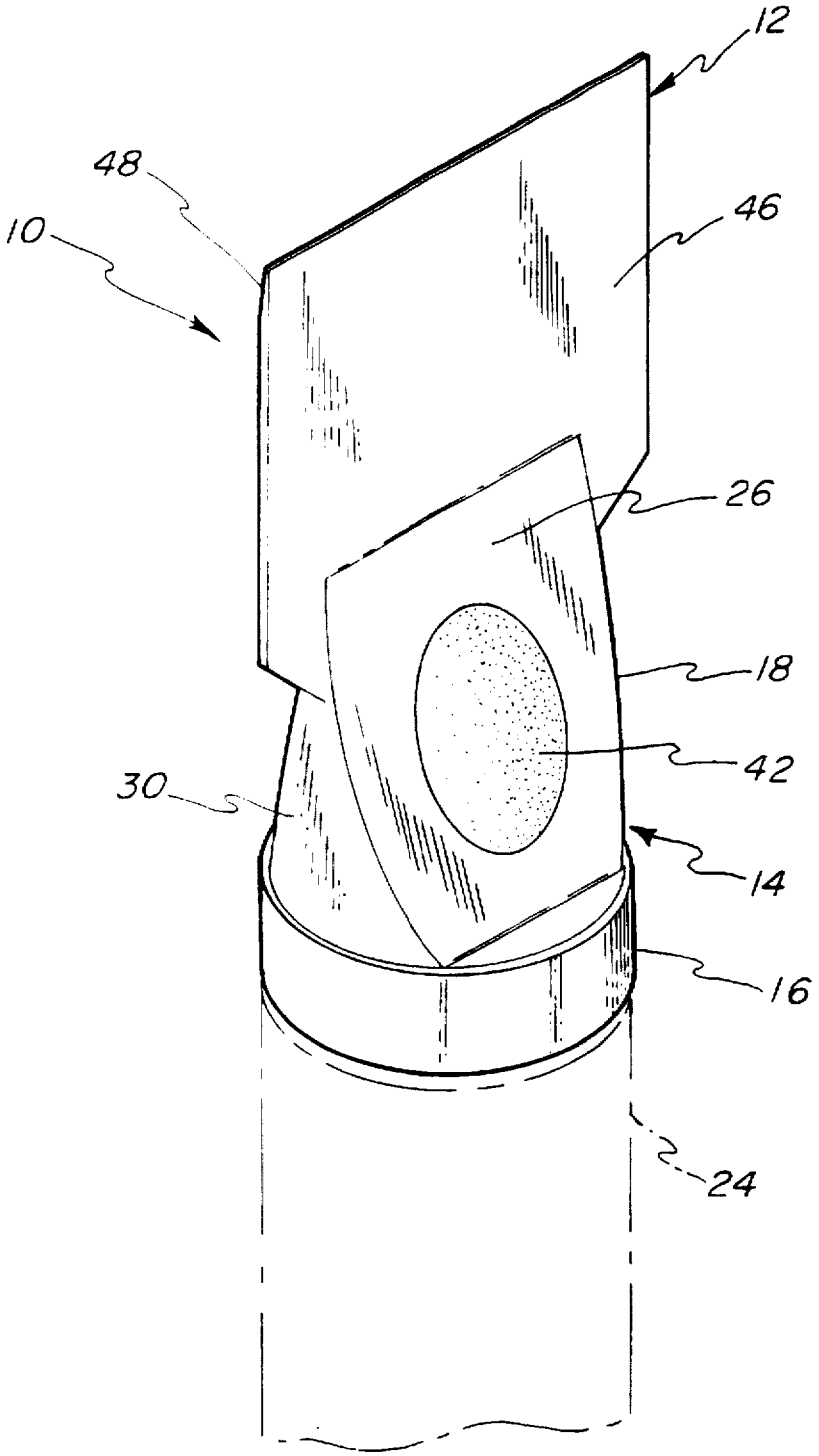
FIG. 1 is a perspective view of the combination cap and material tooling device of the present invention.
Figure 3:
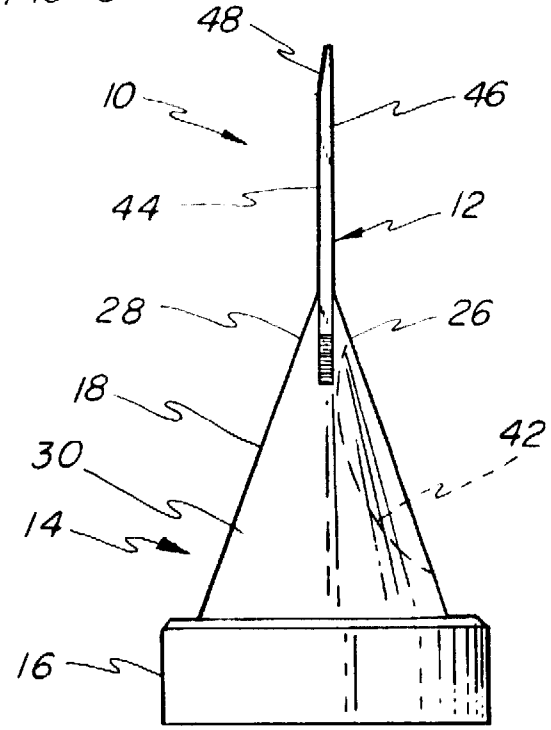
FIG. 3 is a side elevational view thereof.
Figure 2:
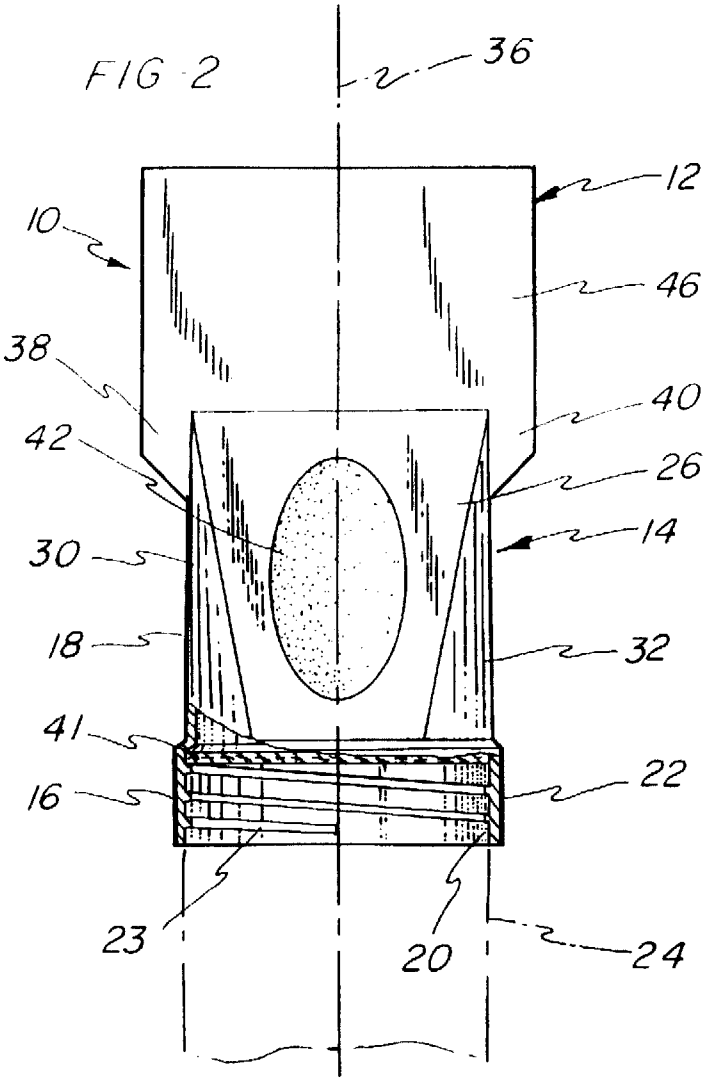
FIG. 2 is a partially cut-away front elevational view thereof.

Referring to FIGS. 1–3, the present invention comprises a combination cap and material tooling device 10 including an elongated blade 12 and a base 14. The base includes an engagement portion 16 and an intermediate portion 18 located between the blade 12 and the engagement portion 16. In addition, it should be noted that the blade 12, engagement portion 16 and intermediate portion 18 are preferably molded integrally with each other of a plastic material.

The engagement portion 16 is cylindrical and includes cylindrical inner and outer walls 20 and 22. In addition, the inner wall 20 is provided with threads 23 for threadably engaging threads formed on the end of an exterior surface of a spackling stick container 24. The base 14 is formed as a closed unit whereby attachment of the engagement portion 16 to the container 24 results in the base 14 preventing air from passing into contact with the contents of the container 24. Thus, the device 10 of the present invention acts as a cap which is effective for maintaining spackling within the container 24 in a soft putty-like consistency during storage of the spackling stick.

Figure 4:
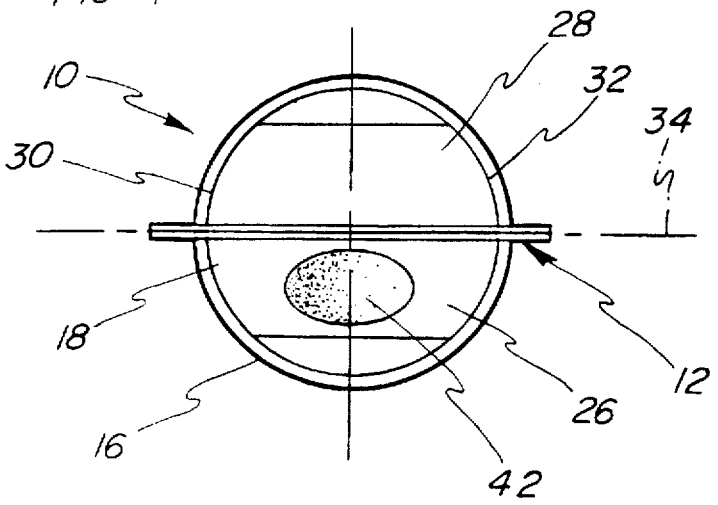
FIG. 4 is a top plan view thereof.
Figure 5:
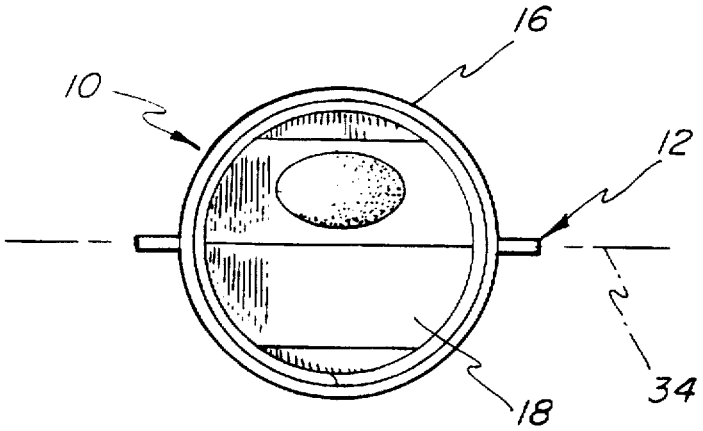
FIG. 5 is a bottom plan view thereof.

The intermediate portion 18 includes opposing substantially planar front and rear faces 26, 28 which are angled toward each other in a direction away from the engagement portion 16. Opposing cylindrically curved side walls 30, 32 connect the front and rear faces 26, 28 and, as may be seen in FIGS. 4 and 5, a plane 34 defined by the blade 12 and lying along the longitudinal axis 36, intersects each of the curved walls 30, 32. In addition, it should be noted that the blade 12 has a width which is greater than the distance between the curved side walls 30, 32, and includes side portions 38, 40 which extend along at least a portion of the curved walls 30, 32, such that the blade 12 provides the device 10 with an appearance that resembles a putty knife.

A foil covered cardboard disk insert 41 is located within the tool 10 at the base of the intermediate portion 18. The insert 41 forms an air seal between the dead air located in the hollow intermediate portion and the spackle stored in the container 24. In addition, the insert 41 acts as a gasket to prevent outside air from entering the container 24 through the area where the engagement portion 16 engages with the container 24.

The intermediate portion 18 further includes a finger depression defined by a circular or oval concave recess 42 formed in the front face 26 for receiving the finger of an operator holding the tool 10. The recess 41, in combination with the tapered shape of the intermediate portion 18, provides a comfortable shape for being held by an operator. Further, the recess 42 also functions as a visual indicator for the operator to assure that the blade 12 is properly oriented during use, as is described further below. Thus, the engagement portion 16 and intermediate portion 18 define a handle for supporting the blade 12 during use of the blade 12 to spread material wherein the curved side walls 30, 32 form convenient grasping surfaces and the recess 42 forms a finger rest and orientation surface.

It should also be noted that the blade 12 includes a substantially planar rear engaging surface 44 opposite from a substantially planar front surface 46, as may be best seen in FIG. 3. The rear surface 44 includes a tapered end portion 48 such that when the tool 10 is held at an angle to the surface, the tapered portion 48 will facilitate passage of material being spread by the blade 12 past the end of the blade 12 to provide the surface being spackled with a smooth professional appearance.

As noted above, the recess 42 facilitates the proper orientation of the blade 12. In other words, when the recess 42 is positioned facing upwardly for receiving the finger of an operator, the rear surface 44 and tapered end portion 48 are oriented facing downwardly to engage a work surface to be spackled. Thus, the recess 42 acts as an indicator to avoid improper use of blade 12, as well as forms a convenient area for receiving the finger of an operator.

Figure 6:
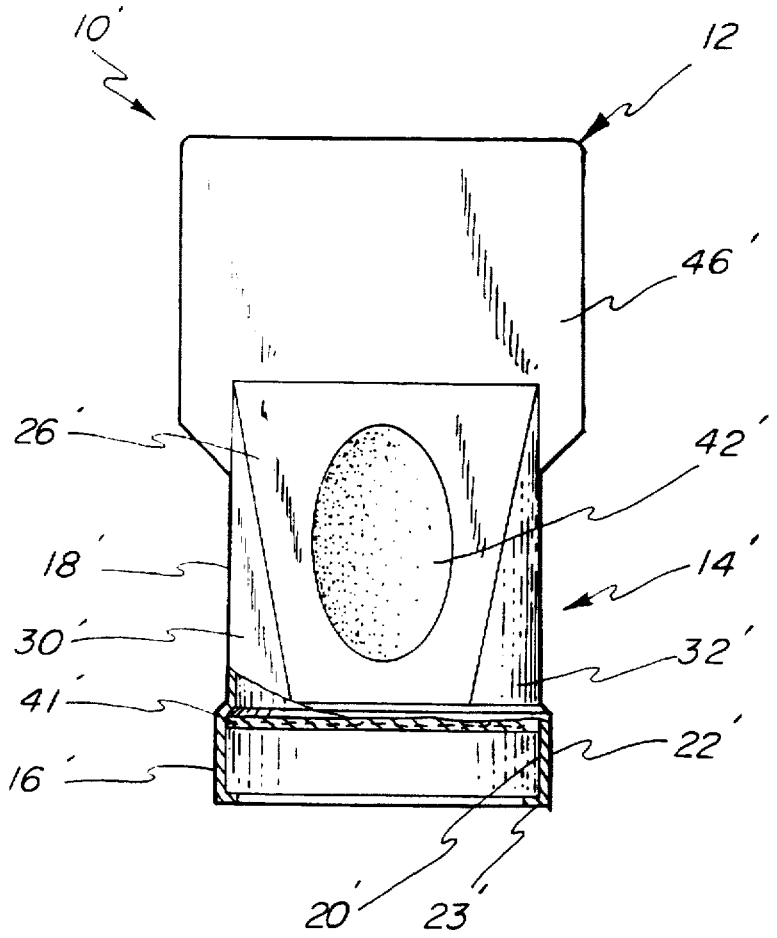
FIG. 6 is a partially cut-away front elevational view showing an alternative embodiment for the engagement portion of the combination cap and material tooling device.

FIG. 6 illustrates an alternative embodiment of the combination cap and material tooling device wherein elements corresponding to elements in the first embodiment are labeled with the same reference numeral primed. The device 10' differs from the tooling device 10 of the previous embodiment in that the inner wall 20' of the engagement portion 16' is provided with a radially inwardly extending lip 23' rather than the threads of the previous embodiment.

The lip 23' provides an alternative means for engaging the threads of a spackling stick container, and is designed to provide a snap fit cooperating with the container threads to firmly hold the device 10' in sealing engagement with the container in the manner described with regard to the first embodiment.

From the above description, it should be apparent that the present invention provides a combination cap and material tooling device which is adapted to effectively seal the opening of a spackling stick container as well as provide a blade for tooling the spackling material provided from within the container. Further, it should be apparent that the present device is provided with a configuration which resembles a spackling knife whereby the device may be conveniently held to perform a conventional spackling operation.

While the forms of apparatus herein described constitute preferred embodiments of the present invention, it is to be understood that this invention is not limited to these precise forms of apparatus and that changes may be made therein without departing from the scope of the invention which is defined in the appended claims.

What is claimed is:

1. A combination cap and material tooling device comprising:

a blade portion;

an engagement portion for engaging a container in sealing engagement;

an intermediate portion extending between said blade portion and said engagement portion wherein said intermediate portion and said engagement portion define a handle for supporting said blade portion; and wherein said intermediate portion includes opposing front and rear faces angled toward each other in a direction away from said engagement portion, wherein said intermediate portion includes a finger depression defined by a concave recess for receiving the finger of an operator and for providing an indicator for properly orienting the blade portion.

2. A combination cap and material tooling device comprising:

an elongated blade portion having a substantially planar work engaging surface for spreading material;

a cylindrical engagement portion for extending around and engaging a container in sealing engagement;

an intermediate portion extending between said blade portion and said engagement portion wherein said intermediate portion and said engagement portion form a base portion adapted to be used as a handle during use of said blade portion to spread material; and wherein said intermediate portion includes front and rear faces and a substantially circular finger depression defined by a concave recess in one of said front and rear faces for receiving a finder of an operator.

3. The device as in claim 2, wherein said intermediate portion includes opposing curved walls and said planar work engaging surface of said blade portion defines a plane intersecting each of said curved walls.

4. The device as in claim 3, wherein said blade portion includes side portions which extend along at least a portion of said curved walls.

5. The device as in claim 2, wherein said front and rear faces comprise substantially planar faces angled toward each other in a direction away from said engagement portion.

6. The device as in claims 5, wherein said intermediate portion has a hollow interior, and including a disk at a bottom portion of said intermediate portion for forming a seal between said hollow interior and material within a container engaged by said engagement portion.

7. The device as in claim 2, wherein said engagement portion includes means for engaging threads on an exterior surface of a container.

8. The device as in claim 2, wherein said work engaging surface of said blade portion includes a tapered end portion for facilitating spreading of material past said blade portion, and said finger depression is located on a side of said blade opposite from said tapered end portion such that said finger depression facilitates orientation of a side of said blade defining said tapered end portion toward a work surface.

9. A combination cap and material tooling device comprising:

an elongated blade having substantially planar front and rear surfaces and said rear surface including a tapered portion for facilitating spreading a pliable material;

a base including an engagement portion and an intermediate portion;

said engagement portion including substantially cylindrical inner and outer walls and said inner wall including threads for threadably engaging external threads on a container;

said intermediate portion being located between said blade and said engagement portion for supporting said blade, said intermediate portion including opposing substantially planar front and rear faces which angle toward each other in a direction away from said engagement portion and opposing curved side walls connecting said front and rear faces wherein said blade defines a plane passing through each of said curved side walls and said blade is formed with a width dimension greater than the distance between said curved side walls; and a finger depression defined by a concave recess formed in said front face for receiving a finger of an operator and for providing an indicator for facilitating proper orientation of said device such that said base is adapted to be used as a handle during use of said blade to spread material.

* * * * *